US007654235B2

(12) United States Patent
Girard

(10) Patent No.: US 7,654,235 B2
(45) Date of Patent: Feb. 2, 2010

(54) VALVE ACTUATING DEVICE

(75) Inventor: Didier Girard, Courdimanche (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 314 days.

(21) Appl. No.: 11/569,421

(22) PCT Filed: May 19, 2005

(86) PCT No.: PCT/FR2005/050346

§ 371 (c)(1),
(2), (4) Date: Nov. 20, 2006

(87) PCT Pub. No.: WO2005/113946

PCT Pub. Date: Dec. 1, 2005

(65) Prior Publication Data

US 2008/0029049 A1 Feb. 7, 2008

(30) Foreign Application Priority Data

May 19, 2004 (FR) ..... 04 51000

(51) Int. Cl.
*F01L 9/04* (2006.01)

(52) U.S. Cl. ..... 123/90.11; 251/129.16

(58) Field of Classification Search ..... 123/90.11; 251/129.01, 129.15, 129.16
See application file for complete search history.

(56) References Cited

U.S. PATENT DOCUMENTS 6,418,892 B1 7/2002 Donce et al.

FOREIGN PATENT DOCUMENTS

| | | | |
|---|---|---|---|
| EP | 1229421 | A | 8/2002 |
| EP | 1357264 | A | 10/2003 |
| EP | 1411212 | A | 4/2004 |
| WO | WO 98/42958 | A | 10/1998 |
| WO | WO 00/65203 | A | 11/2000 |

OTHER PUBLICATIONS

International Search Report mailed Sep. 29, 2005 in PCT/FR2005/050346.

*Primary Examiner*—Ching Chang
(74) *Attorney, Agent, or Firm*—Nicolas E. Seckel

(57) ABSTRACT

The invention relates to an actuating device that actuates engine valves, comprising magnetizing means, a spring having a fixed end connected to an adjustable stop and having a moving end connected to the valve (1). The adjustable stop comprises meshing means (26) that can interact with a control element (8, 10) whereby enabling the tare of the spring to be adjusted, and comprises an orifice (11) located between the adjustable stops of the two valves (1) of the same pair and serving to accommodate the control element (8, 10). The invention is characterized in that the control element (8, 10) comprises positioning means (12) that interact with complementary means (13) whereby making it possible to locate two stable positions respectively corresponding to the meshing positions with the two adjustable stops of the two valves (1) and to immobilize the control element (8, 10) in these positions.

14 Claims, 5 Drawing Sheets

VALVE ACTUATING DEVICE

The invention relates to a valve actuating device.

BACKGROUND ART

The invention concerns more particularly a device for actuating at least one pair of valves of an internal combustion engine disposed in a housing of the type comprising, for each valve, magnetizing means, at least one spring acting on the valve toward an equilibrium position and comprising a fixed end made integral with an adjustable stop and a movable end made integral in translation to the valve, the stop comprising meshing means adapted to cooperate with mating meshing means of a control element to enable the movement of the stop with respect to the housing, so as to adjust the tare of the spring, the housing comprising an orifice located between the adjustable stops of the two valves of a same pair and intended to receive the control element adapted to cooperate selectively with the two adjustable stops of the two adjacent valves.

Such a device is described in the document WO0065203A1. To perform the adjustment of the tare of the valve springs, the device described in this document uses a tool introduced between two adjacent valve actuators. The tool is constituted by a rod equipped at its end with a disc portion whose border has a toothed sector. The toothed sector of the tool is designed to mesh with a toothed wheel whose rotation controls the movement of a movable equipment integral with one end of a spring.

However, the adjustment of the tare of a spring according to this device is difficult. Indeed, the tool must be introduced with a certain orientation in the device, to enable the toothed sector to penetrate inside the device. The tool is then moved laterally toward the toothed wheel of the movable equipment associated to a spring. The toothed sector must then be brought blindly into a position in which it meshes with the toothed wheel. In this position which is difficult to reach, the toothed sector can be set in rotation to perform the adjustment of the tare of the spring. When the springs of two adjacent valves must be adjusted, the tool which has performed the adjustment of a first spring must then be moved laterally to mesh with the adjacent toothed wheel according to the same procedure.

The structure of such a valve control device requires thus complex adjustment operations which are hardly compatible with a large-scale industrial production. In addition, the complexity of the operations required for the adjustment of the tare for the springs is susceptible to causing adjustment errors.

SUMMARY OF THE INVENTION

An objective of the present invention is to remedy all or part of the drawbacks of the prior art as described above.

To this effect, the actuating device of the present invention, otherwise conform to the generic definition given in the preamble above, is essentially characterized in that the control element comprises positioning means intended to cooperate with complementary positioning means formed on the housing, so as to enable, on the one hand, identifying two stable positions corresponding to the positions meshing with the two adjustable stops of the two valves, respectively, and, on the other hand, immobilizing the element in said positions.

Further, the invention can comprise one or more of the following characteristics:

- the control element and the orifice have conjugated dimensions preventing the lateral movement of the control element inside the orifice between the two stable positions,
- the control element and the orifice have conjugated dimensions adapted to enable, on the one hand, removing the control element from the orifice from a first stable position, and, on the other hand, reintroducing it into the orifice in the second stable position,
- the stop and the control element cooperate by meshing during their rotation, and when the control element is in a stable position, the respective rotation axes of the stop and of the control element are not co-linear and are preferably substantially perpendicular,
- the positioning means comprise an axle mounted on the control element and two orifices formed on the housing and intended to accommodate the axle selectively.
- the control element and the orifice have generally oblong shapes,
- the control element comprises a sleeve and an actuating axle equipped with the meshing means, the actuating axle being disposed in an excentered manner in the sleeve with respect to the longitudinal axis of the sleeve,
- the device comprises means for blocking the axle in translation with respect to the sleeve, said blocking means authorizing the rotation of the axle with respect to the sleeve,
- the axle is threaded, and said meshing means of the stop are constituted by complementary teeth,
- the orifice has a depth substantially equal to the length of the control element so that, when the control element is disposed in the housing in a stable position, an end of the control element is substantially flush in the area of a face of the housing, the flush end of the control element comprising means for coupling with an adjustment element,
- the stop comprises a threaded ring mounted on the outside threading of a sleeve equipped with meshing means, the sleeve being mounted free in rotation and blocked in translation with respect to the housing, the threaded ring being blocked in rotation with respect to the housing, so that the rotation of the sleeve causes the movement of the threaded ring along the length of said sleeve,
- the sleeve has a general shape of a cylindrical tube, an end of which comprises a flange, and the meshing means are formed on the flange,
- the device comprises, for each valve, a paddle made integral in translation with the valve, the paddle being disposed between two magnetizing means, the device comprising also two antagonistic springs acting on the valve/paddle group toward an equilibrium position.

BRIEF DESCRIPTION OF THE DRAWINGS

Other particularities and advantages will appear upon reading the following description made in reference to the Figures in which.

DETAILED DESCRIPTION OF PARTICULAR EMBODIMENTS

Figure 1:
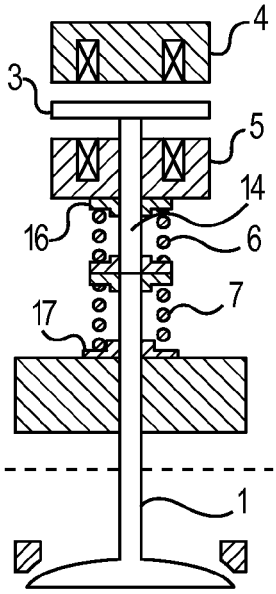
FIG. 1 is a schematic longitudinal cross-section view of an electromagnetic valve to which the invention can be applied.

The invention applies to valves of an internal combustion engine which are actuated in an electromagnetic manner. FIG. 1 illustrates an example of an actuator of such a valve called "electromagnetic valve." The actuator comprises classically a movable part constituted by a rod 14, and end of which is integral with a paddle 3 disposed between two electromagnets 4, 5 (see also FIG. 4). The other end of the movable rod 14 is supported on the end of the rod of the valve 1.

Two springs, upper spring 6 and lower spring 7, are mounted in an antagonistic manner on the rod/valve group 14, 1 so as to act on the group toward an equilibrium position (position shown on FIG. 1). Each of the springs 6, 7 comprises a fixed end made integral with a fixed stop and a movable end made integral in translation directly or indirectly with the valve and/or the movable rod 14. The paddle 3 is subjected to the action of the electromagnets 4, 5, so as to move and block the valve 1 in open or closed position. The paddle 3 and the valve 1 can be balanced by the springs 6, 7 between the two, open and closed, positions. The tare of the springs 5, 6 must be adjusted so that, when the electromagnets 4, 5 are not activated, the valve 1 and the paddle 3 are disposed in the equilibrium position between the open and closed positions.

In general, only one of the two springs 6 associated to a valve 1 has an adjustable tare, to make it possible to equalize its tare with that of the other spring 7.

Figure 2:
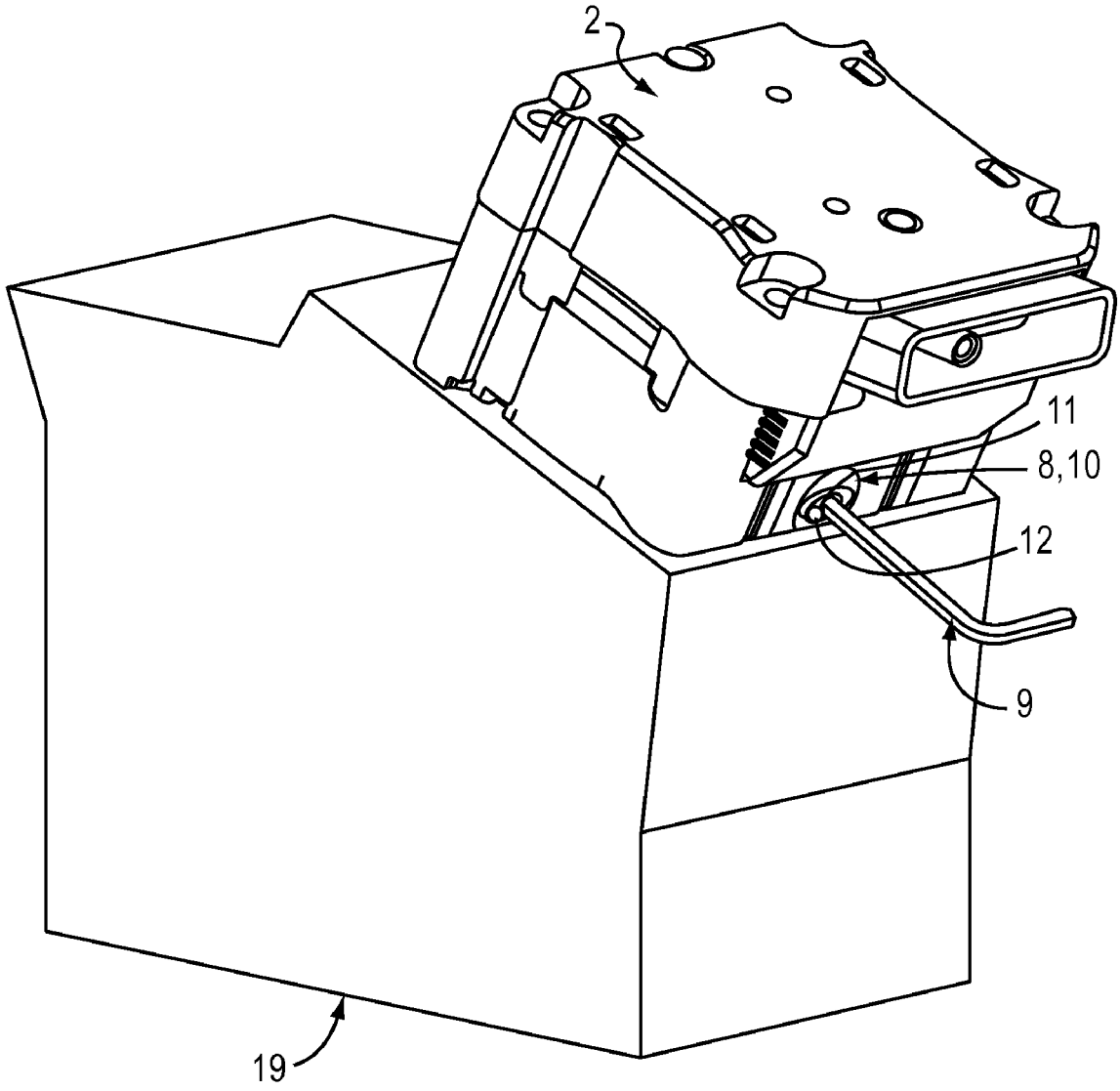
FIG. 2 is a perspective view illustrating schematically a valve actuating device according to the invention, mounted on a cylinder head of an internal combustion engine.

As shown on FIG. 2, the control mechanism of the valves 1 is generally integrated into a housing 2 called "actuator" which is mounted directly or indirectly on the cylinder head 19 of an internal combustion engine.

Figure 3:
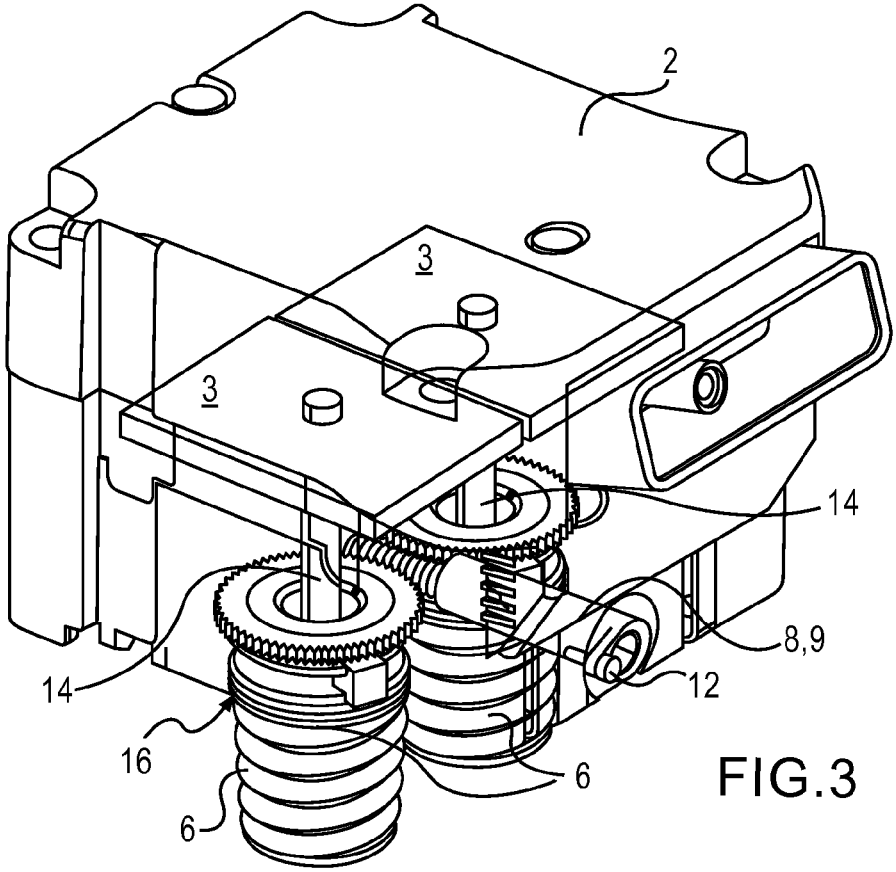
FIG. 3 is a perspective view showing schematically a portion of the arrangement of a device for actuating a pair of valves according to the invention.

FIGS. 2 and 3 show a portion of the mechanism of FIG. 1. For simplification purposes, elements identical to those described above are designated with the same reference numerals and will not be described in details a second time.

Figure 4:
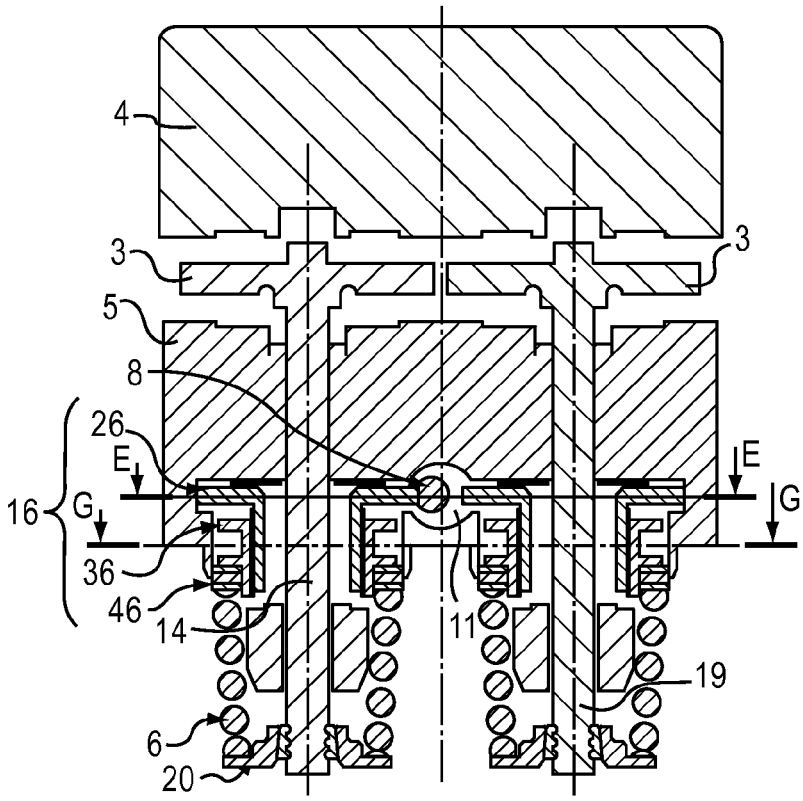
FIG. 4 is a longitudinal cross-section view of the actuating device of FIG. 3.
Figure 5:
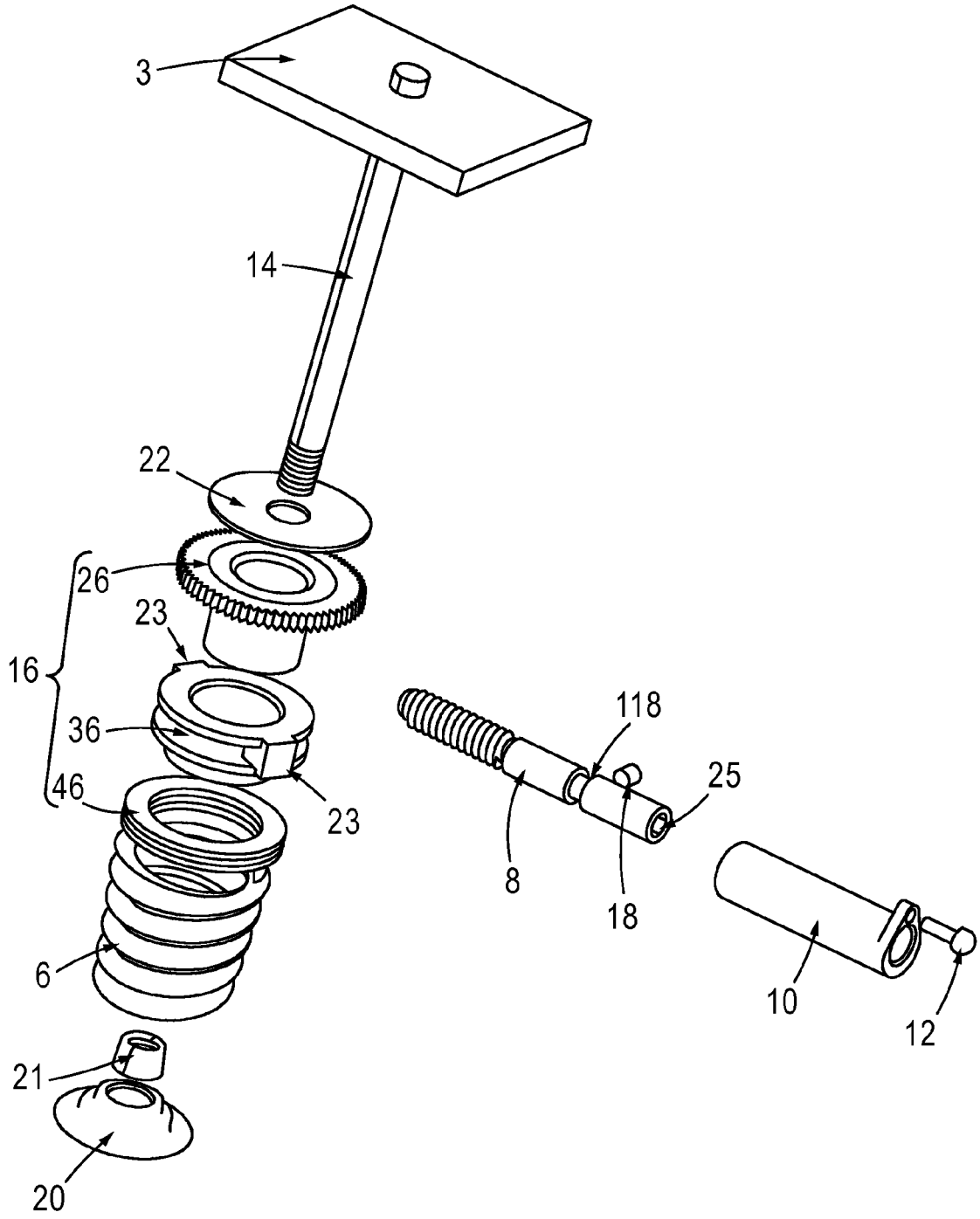
FIG. 5 is an exploded perspective view of a portion of the actuating device of FIGS. 2 and 3, illustrating a portion of the control mechanism of one of the two valves.

As shown on FIGS. 4 and 5, the upper spring of the mechanism has a first movable lower end which is made integral with the movable rod 14 by means of a lower cup 20 and a conical coupling device 21. The upper end of the spring 6 is made integral with a support washer 46 comprising, for example, three rings (see FIG. 5). The support washer 46 is itself mounted on a threaded ring 36 screwed on the outside thread of a cylindrical sleeve 26.

The sleeve 26 is mounted free in rotation and blocked in translation with respect to the housing 2. More precisely, the sleeve 26 comprises at its upper end a flange supported on the body of the actuator (electromagnet 5, for example) via a support washer 22. Teeth are formed on the outside border of the flange of the sleeve 26 (see FIG. 5 in particular).

Figure 6:
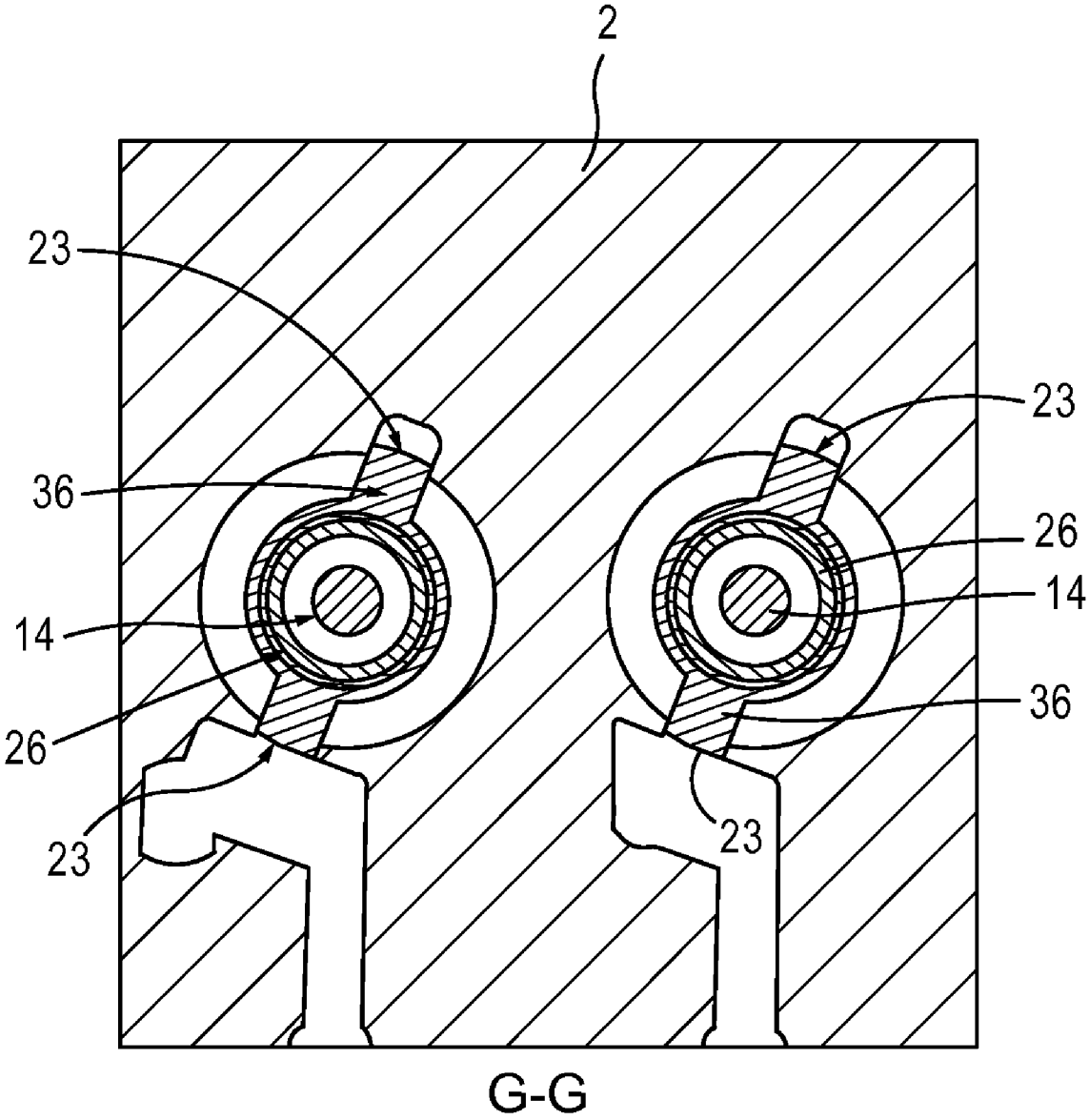
FIG. 6 is a cross-section view of the device according to line GG of FIG. 2.

The threaded ring 36 is blocked in rotation with respect to the housing 2. For example, as shown on FIG. 6, the threaded ring 36 comprises shoulders which engage into recesses in the body of the housing 2 and prevent the rotation of the ring 36 around its axis.

According to this arrangement, thus, the rotation of the sleeve 26 triggers the movement of the threaded ring 36 toward the length of said sleeve 26. The direction of movement of the threaded ring 36 along the length of the sleeve 26 is determined by the direction of rotation of the sleeve 26.

The group constituted by the sleeve 26, the threaded ring 36 and the support washer 46 forms an adjustable stop 16 for the upper end of the spring 6, as described in more details below.

The teeth of the sleeve 26 are intended to cooperate with a complementary threading of a control element 10 which has preferably an oblong shape. To this effect, the housing 2 comprises a receptacle 11 located in the proximity of the adjustable stops 16 of the two valves 1 of a same pair of valves and intended to receive the control element 8, 10.

The orifice 11 is preferably oblong and substantially perpendicular to the rotation axes of the adjustable stops 16. I.e., the orifice 11 has a longitudinal axis substantially perpendicular to the movable rods 14 of the actuating mechanism of the adjacent valves 1.

According to an advantageous embodiment of the invention, the control element comprises a sleeve 10 and a actuating screw 8 housed in the sleeve 10. the threaded end of the actuating screw 8 protrudes outside of the sleeve 10, so as to enable it to mesh with the threading of the sleeve 26 (see FIGS. 3, 5, 7, and 8).

Preferably, the sleeve 10 has unsymmetrical transverse dimensions with respect to its longitudinal axis. For example, the screw 8 is disposed in an excentered manner in the sleeve 10 with respect to the median longitudinal axis of the sleeve 10 (see FIGS. 5, 7, and 8).

The sleeve 10 comprises in its thickness means 18 for blocking the screw 8 in translation with respect to the sleeve 10. These blocking means can comprise, for example, a pin 18 cooperating with an annular groove 118 formed on the body of the screw and authorizing the rotation of the screw 8 with respect to the sleeve 10 (see FIG. 5).

Figure 7:
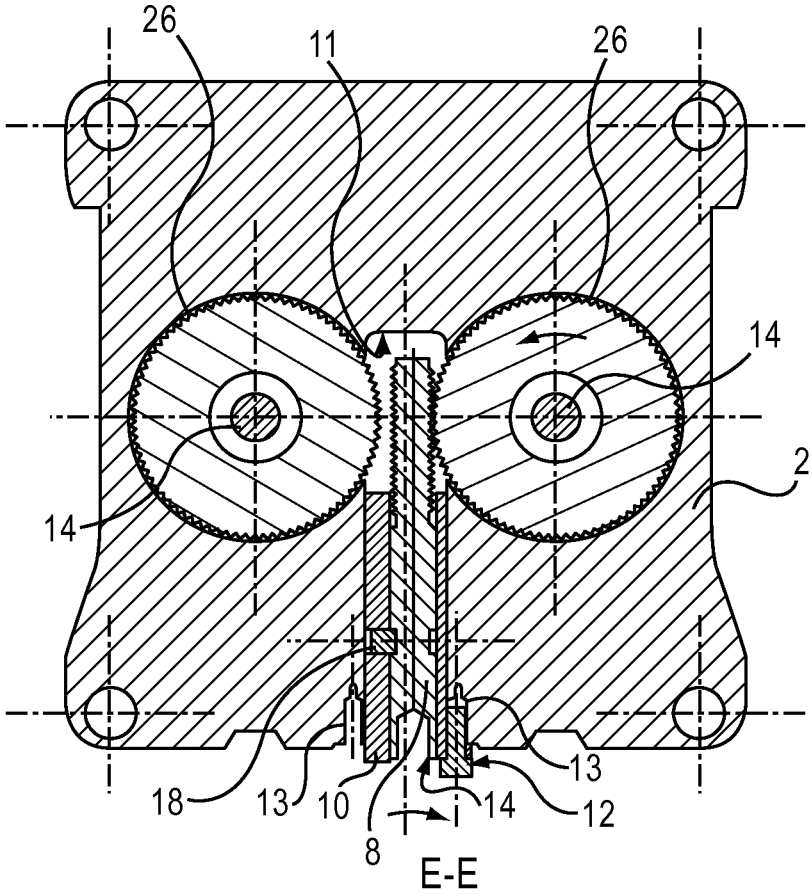
FIG. 7 is a cross-section view of the device according to line EE of FIG. 4.

The control element (screw 8 and sleeve 10) and the orifice 11 have conjugated transverse dimensions preventing the lateral movement of the control element 8, 10 inside the orifice 11 (see FIG. 7).

I.e., the control element 8, 10 cannot move laterally inside the orifice 11 between the two meshing positions corresponding to the meshing positions of the screw 8 with the two adjacent adjustable stops 16, respectively.

Preferably, the sleeve 10 and the orifice 11 have conjugated dimensions adapted to enable, on the one hand, removing the control element 8, 10 out of the orifice along a direction parallel to the longitudinal axis of the orifice 11. Thus, from a first meshing position, the control element 8, 10 can be removed from the orifice 11, then pivoted by 90 degrees around its longitudinal axis, and then reintroduced in the second meshing position.

According to the invention, the control element 8, 10 comprises positioning means 12 intended to cooperate with complementary positioning means 13 formed on the housing 2, so as to enable, on the one hand, identifying two meshing positions, and on the other hand, immobilizing the element 8, 10 in said positions.

For example, the positioning means 12 comprise an axle 12 such as a screw mounted on the sleeve 10 and two positioning orifices 13, for example, threaded orifices, formed on the housing 2 and intended to receive selectively the axle 12. Preferably, the positioning axle 12 is parallel to the longitudinal axis of the screw. Thus, the two positioning orifices 13 are parallel to the longitudinal axis of the oblong orifice 11.

Figure 8:
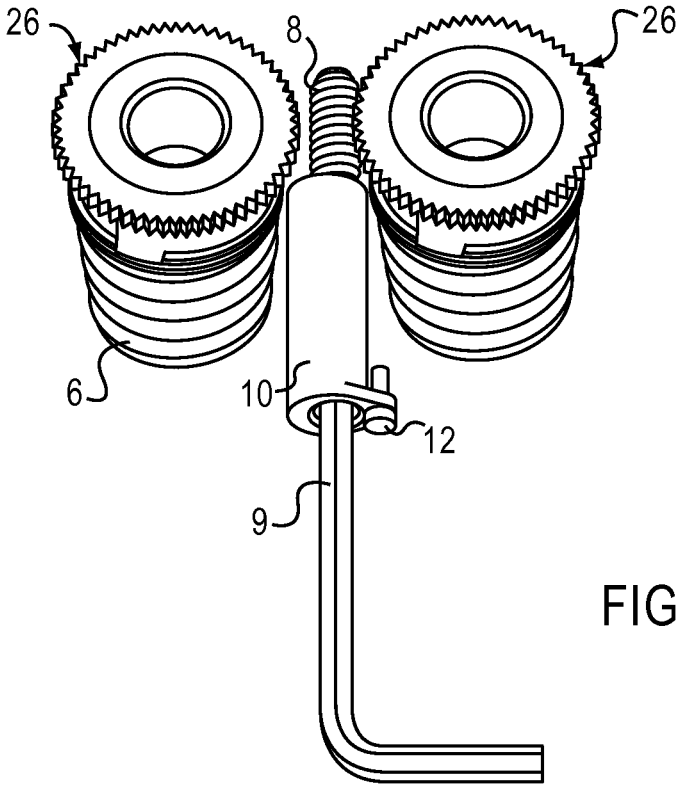
FIG. 8 is a perspective view of a detail of the device of FIG. 2.

FIGS. 7 and 8 illustrate the perfect positioning, according to the invention, of the threading of the screw 8 against the threading of the sleeve 26 when the control element 8, 10 is disposed in the orifice 11.

The screwing of the axle 12 in an orifice 13 of the housing enables an operator to determine without ambiguity the spring that he is in the process of adjusting, and thus, it minimizes the risks of adjustment errors.

Further, the orifice 11 has a depth which is preferably substantially equal to the length of the control element 8, 10. In this manner, when the control element 8, 10 is disposed in the housing 2 in a meshing position, an end of the control element 8, 10 is substantially flush in the area of a face of the housing 2. Thus, the flush end of the control element 8, 10 can comprise coupling means 25, such as a recess, intended to cooperate with an additional adjustment element 9 such as a wrench, for example (see FIGS. 2 and 8).

It is easily understood that, while having a simple and inexpensive construction, the device according to the invention makes it possible to adjust the valve springs more simply than according to the prior art.

The invention claimed is:

1. A device for actuating at least one pair of adjacent valves of an internal combustion engine disposed in a housing of a type comprising, for each valve, magnetizing means, at least one spring acting on the valve toward an equilibrium position and comprising a fixed end made integral with an adjustable stop and a movable end made integral in translation with the valve, the adjustable stop comprising meshing means adapted to cooperate with mating meshing means of a control element to enable the movement of the adjustable stop with respect to the housing, so as to adjust the tare of the spring, the housing comprising an orifice located between the adjustable stops of the pair of adjacent valves of a same pair and that receives a control element adapted to cooperate selectively with the two adjustable stops of the pair of adjacent valves, wherein the control element comprises positioning means that cooperates with complementary positioning means formed on the housing, so as to enable, on the one hand, identifying two stable positions corresponding to positions meshing with the two adjustable stops of the two valves, respectively, and, on the other hand, immobilizing the element in said positions.

2. The device according to claim 1, wherein the control element and the orifice have conjugated dimensions preventing the lateral movement of the control element inside the orifice between the two stable positions.

3. The device according to claim 1, wherein the control element and the orifice have conjugated dimensions so as to enable, on the one hand, removing the control element from the orifice from a first of said two stable positions, and, on the other hand, reintroducing it into the orifice in a second of said two stable positions.

4. The device according to claim 1, wherein the stop and the control element move in respective rotations around respective rotation axes, and the stop and the control element cooperate by meshing during their rotations, and, when the control element is in a stable position, the respective rotation axes of the stop and of the control element are not co-linear.

5. The device according to claim 4, wherein, when the control element is in a stable position, the respective rotation axes of the stop and of the control element are substantially perpendicular.

6. The device according to claim 1, wherein the positioning means comprise an axle mounted on the control element and two orifices formed on the housing so as to accommodate the axle selectively.

7. The device according to claim 1, wherein the control element and the orifice have generally oblong shapes.

8. The device according to claim 1, wherein the control element comprises a sleeve and an actuating axle equipped with the meshing means, the actuating axle being disposed in an excentered manner in the sleeve with respect to the longitudinal axis of the sleeve.

9. The device according to claim 8, wherein the The device comprises means for blocking the axle in translation with respect to the sleeve, said blocking means authorizing the rotation of the axle with respect to the sleeve.

10. The device according to claim 8, wherein the axle is threaded, and said meshing means of the stop are constituted by complementary teeth.

11. The device according to claim 1, wherein the orifice has a depth substantially equal to the length of the control element so that, when the control element is disposed in the housing in a stable position, an end of the control element is substantially flush in the area of a face of the housing, the flush end of the control element comprising means for coupling with an adjustment element.

12. The device according to claim 1, wherein the stop comprises a threaded ring mounted on the outside threading of a sleeve equipped with meshing means, the sleeve being mounted free in rotation and blocked in translation with respect to the housing, and the threaded ring is blocked in rotation with respect to the housing, so that the rotation of the sleeve triggers the movement of the threaded ring along the length of said sleeve.

13. The device according to claim 12, wherein the sleeve has a general shape of a cylindrical tube, and end of which comprises a flange, and the meshing means are formed on the flange.

14. The device according to claim 1, which comprises, for each valve, a paddle made integral in translation with the valve, the paddle being disposed between two magnetizing means, and two antagonistic springs acting on the valve/paddle group toward an equilibrium position.

* * * * *